US005325743A

United States Patent [19]

Engel

[11] Patent Number: 5,325,743

[45] Date of Patent: Jul. 5, 1994

[54] AUTOMOTIVE RATCHET WRENCH

[75] Inventor: Darryl L. Engel, LaOtto, Ind.

[73] Assignee: Universal Tool & Stamping Company, Inc., Butler, Ind.

[21] Appl. No.: 70,909

[22] Filed: Jun. 4, 1993

[51] Int. Cl.[5] ..... B25B 13/46

[52] U.S. Cl. ..... 81/61

[58] Field of Search ..... 8/60, 61, 63

[56] References Cited

U.S. PATENT DOCUMENTS

| | | | |
|---|---|---|---|
| 1,455,147 | 5/1923 | O'Neill . | |
| 1,459,291 | 6/1923 | Hall | 81/61 |
| 1,733,012 | 10/1929 | Henderson | 81/61 |
| 1,903,514 | 4/1933 | Merriman . | |
| 2,500,835 | 3/1950 | Lang . | |
| 2,507,455 | 5/1950 | Ott . | |
| 3,742,788 | 7/1973 | Priest . | |
| 5,010,792 | 4/1991 | Clarno . | |
| 5,157,994 | 10/1992 | Krivec . | |

*Primary Examiner*—James G. Smith

*Attorney, Agent, or Firm*—Hill, Steadman & Simpson

[57] ABSTRACT

The present invention comprises a ratchet wrench which has a pawl and spring arrangement such that the pawl's rotational movement is limited when out of engagement with the ratchet wheel so as to assure that the spring does not become disengaged from the pawl to render the wrench inoperative. The spring is provided with a pivotal action which eliminates loading on the end of the spring and provides more desirable spring action.

3 Claims, 2 Drawing Sheets

FIG. 5
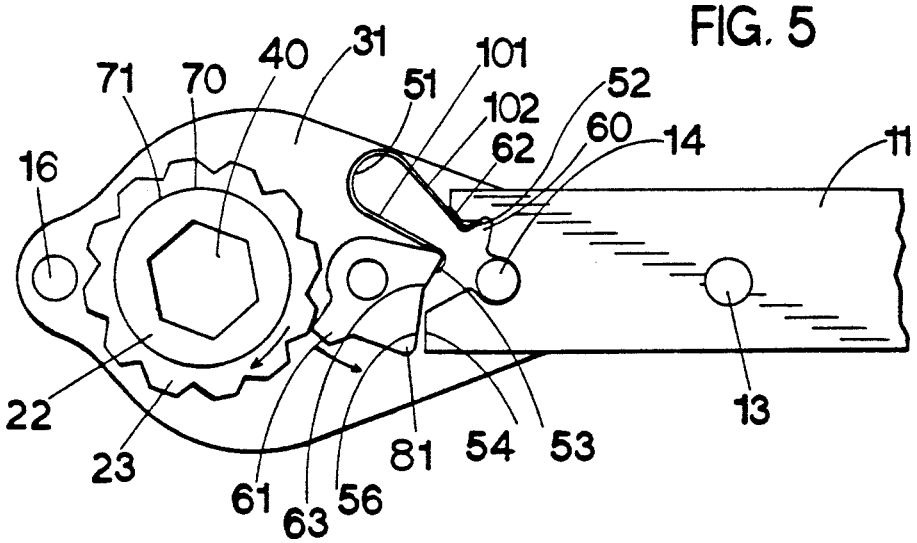
FIG. 6
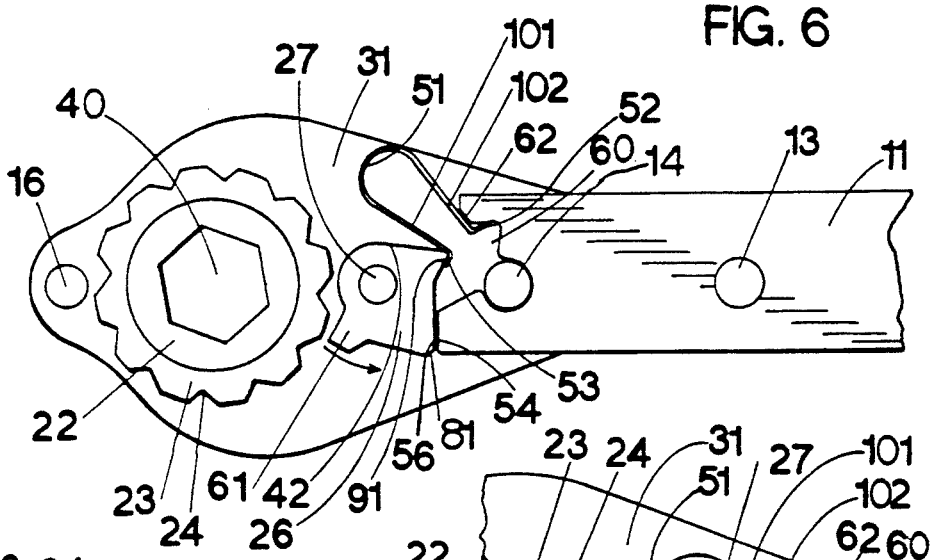
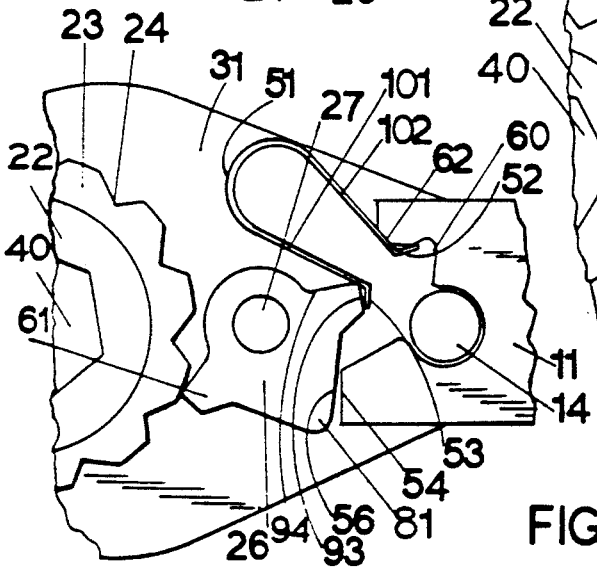
FIG. 8
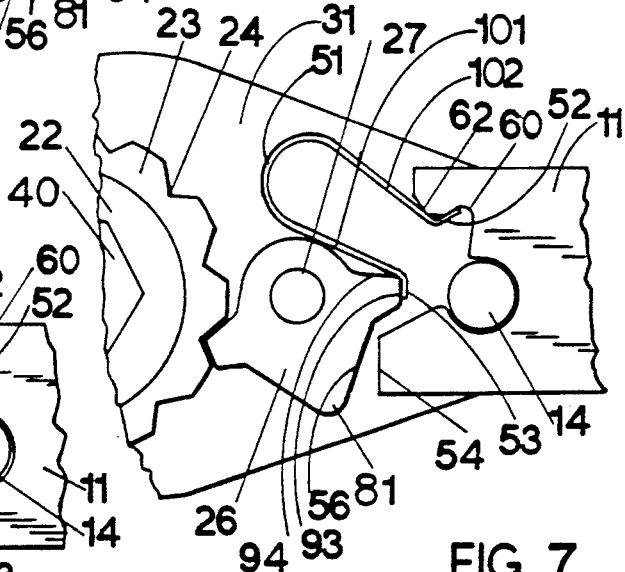
FIG. 7

AUTOMOTIVE RATCHET WRENCH

BACKGROUND OF THE INVENTION

1. Field of the Invention

This invention relates in general to a ratchet wrench and in particular to an improved ratchet wrench which has an improved pawl and spring.

2. Description of Related Art

Prior art ratchet wrenches utilize a pivoted pawl which engages a ratchet wheel to stop its motion in one direction and which allows it to turn in the opposite direction. A spring engages the pawl to bias it. Under certain conditions, the pawl can rotate beyond its intended position such that the spring disengages the pawl and can fall out of the wrench. When this occurs, the ratchet wrench is rendered inoperative.

See also U.S. Pat. Nos. 5,010,792, 3,742,788, 5,157,994, 2,500,835, 1,903,514, 1,459,591, 1,455,147 and 2,507,455.

SUMMARY OF THE INVENTION

The present invention relates to an improved ratchet wrench which has a pivoted pawl and spring that engages the pawl such that the rotational movement of the pawl is limited so that the spring stays in engagement with the pawl at all times. The spring is provided with a pivotal action which eliminates loading on the tip of the spring and provides a more desirable spring action. This also allows greater manufacturing tolerances to be utilized.

In the present invention, a cut-out in the handle for receiving the spring and engaging the pawl can be stamped which reduces manufacturing costs and also the cut-out changes the spring contact from the tip of the spring to the side of the spring.

It is an object of the present invention to provide an improved more reliable ratchet wrench.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

BRIEF DESCRIPTION OF THE DRAWINGS

FIG. 5 is a partially cut-away plan view of the ratchet wrench with the top cover removed;

FIG. 6 is a partially cut-away detail view of the ratchet wrench with the top cover removed;

FIG. 7 is a partially cut-away plan view with the top cover member removed; and FIG. 8 is a partially cut-away top plan view with the top cover member removed.

DETAILED DESCRIPTION OF THE PREFERRED EMBODIMENTS

Figure 1:
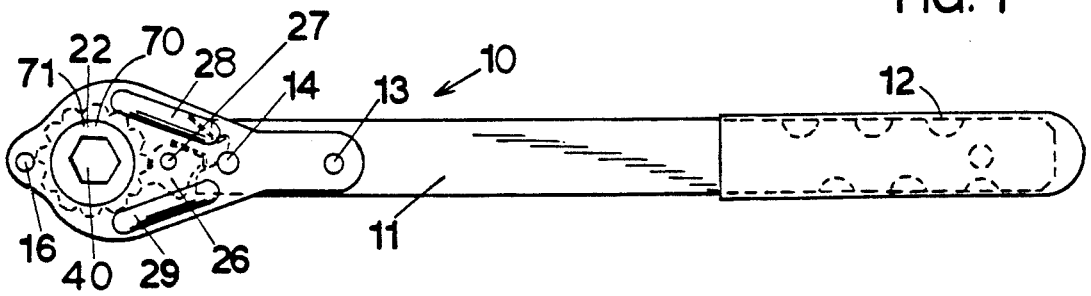
FIG. 1 is a top plan view of the ratchet wrench of the invention.
Figure 2:
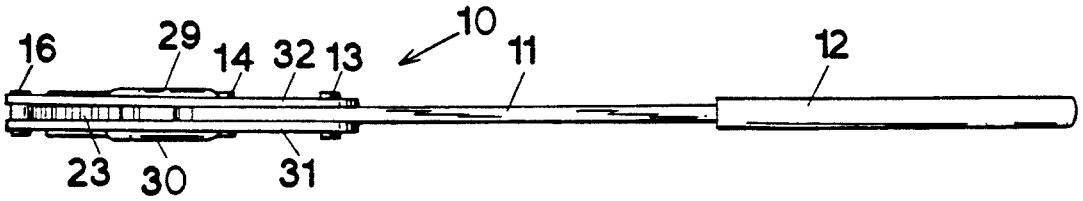
FIG. 2 is a side plan view of the ratchet wrench of the invention.

FIGS. 1 and 2 illustrate the improved ratchet wrench 10 of the invention which comprises a handle 11 which has a rubber grip 12 on one end. A ratchet wheel 22 formed with a nut engaging opening 40 is rotatably mounted at the other end of the handle 11. A pair of plates 31 and 32 are mounted on opposite sides of the handle 11 by rivets 13 and 14 and are connected together by an end rivet 16. Reinforcing ribs 28 and 29 are formed in the upper end plate 32 and reinforcing ribs 30 are formed in the lower plate 31. Openings 70 are formed in the end plates 31 and 32 and engage a shoulder portion 71 on ratchet wheel 22 so that it is rotatably supported by the ratchet wrench 10. A pawl 26 is rotatably supported by rivet 27 from the upper and lower end plates 31 and 32 and has a first projection 61 engageable with the teeth 23 of the ratchet wheel 22. The projection 61 is formed with a right angle corner which engages the mating depressions 24 in the toothed ratchet wheel 22 as shown, for example, in FIG. 3. A second projection 81 extends from the pawl 26 and has a straight portion 56 which is engageable with a straight portion 54 formed in the end of the handle 11 when the pawl 26 is out of engagement with the ratchet wheel 22 as illustrated in FIG. 6, for example.

Figure 3:
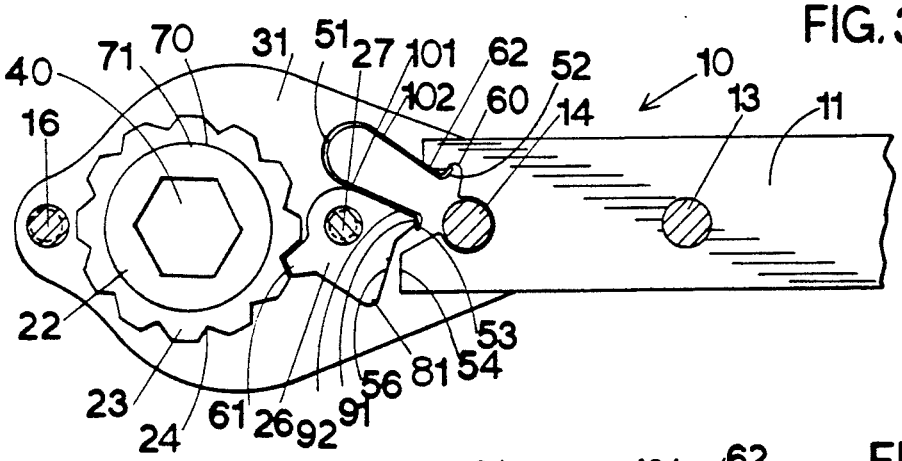
FIG. 3 is a cut-away view of the ratchet wrench with the top cover member removed.

A third projection 91 is formed in the pawl 26 and has an adjoining flat portion 92 which engages one of the ends 101 of a spring 51 when the pawl 26 is in the full clockwise position relative to FIG. 3. The other leg 102 of the U-shape spring 51 is received in a cut-out 60 formed in the end of the handle 11. The spring 51 has curved ends 52 and 53 and the end 52 is received in the cut-out 60 and the end 53 fits over the projection 91 of the pawl 26. The end of the handle 11 has a surface 62 which engages the leg 102 of the spring 51.

Figure 4:
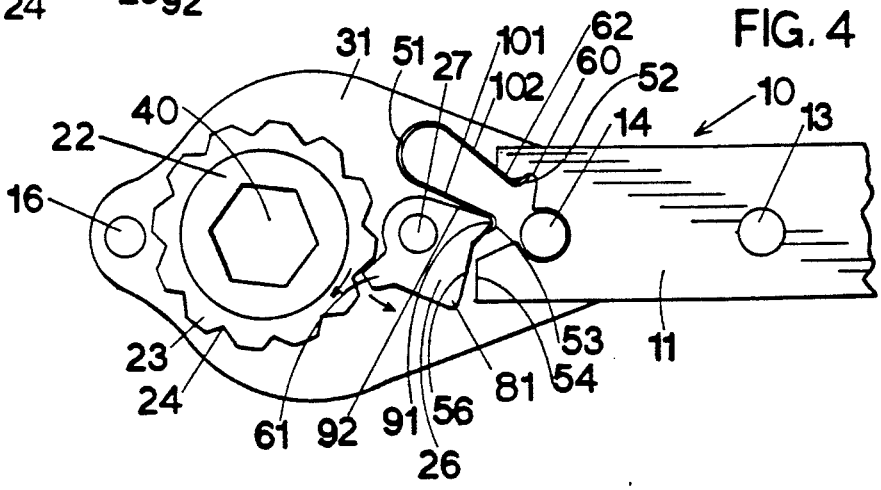
FIG. 4 is a partially cut-away detail view of the ratchet wrench with the top cover member removed.

In use, FIG. 3 is a partially cut-away plan view of the ratchet wrench with the top plate 32 removed so as to show the pawl 26 in the engaged position for turning a nut received in the opening 40 of the ratchet wheel 22 in the clockwise direction. As the handle 11 is pulled downwardly in the clockwise direction relative to FIG. 3, the extension 61 which fits in the depression 24 of the tooth 23 rotate the ratchet wheel 22 in the clockwise direction. FIG. 4 is a view similar to FIG. 3 wherein the ratchet handle 11 as rotated the nut in the opening 40 and the ratchet handle is being rotated counterclockwise so as to move the pawl 26 to engagement with another tooth of the ratchet wheel 22.

FIG. 5 is another similar view with the handle 11 rotated further in the counterclockwise direction relative to the ratchet wheel 22 wherein the projection 61 has been moved out of the depression 24 and the ratchet teeth 23 so that the handle 11 can be freely moved in a counterclockwise direction.

FIG. 6 is a similar view to FIG. 5 wherein the pawl 26 has moved completely out of engagement with the ratchet wheel 22 and wherein the projection 81 has moved so the surface 56 engages the surface 54 of the handle 11. In this position, the handle 11 can freely be rotated in the counterclockwise direction relative to the ratchet wheel 22. In the position of FIG. 6, wherein the pawl 26 has been stopped by the surface 54, the spring 51 continues to exert a bias on the pawl 26 to rotate it in the clockwise direction relative to FIG. 6 so that as soon as the handle 11 has been stopped in the counterclockwise direction, the spring 51 will cause the pawl 26 to move so that the projection 61 engages the ratchet wheel 22 to cause the projection 61 to move into the depression 24 of the teeth 23 so that the ratchet wrench can again rotate the ratchet wheel 22 in the clockwise direction.

FIGS. 7 and 8 illustrate a modified form of the pawl wherein the spring engaging projection 93 is formed with a somewhat flat portion which rests against the end 53 of the spring in the engaged position shown in FIG. 7 and bears against the end 53 and the leg 101 of the spring 61 as the ratchet handle is rotated in the counterclockwise direction as shown in FIG. 8. The cut-out 60 in the end of the handle 11 can be formed by stamping.

The structure of the pawl and the spring of the present invention assures that the rotational movement of the pawl is limited so that the spring stays engaged at all times. The invention also provides the spring with a pivotal action which eliminates loading on the tip of the spring and provides a more desireable spring action. This allows greater manufacturing tolerances. The shape of the cut-out 61 in the handle 11 changes the spring contact from the tip in the prior art devices to the side in the present invention.

Although the invention has been described with respect to preferred embodiments, it is not to be so limited as changes and modifications can be made therein which are within the full intended scope as defined by the appended claims.

I claim as my invention:

1. An improved ratchet wrench comprising, a flat handle, first and second end plates with said first plate attached at a first end of said handle to a first side of said handle and said second end plate attached to said first end of said handle to a second side of said handle, first and second aligned openings formed in said first and second end plates, a ratchet wheel with a nut engaging opening rotatably mounted in said first and second aligned openings, teeth formed on the outer surface of said ratchet wheel and having substantially right angle surfaces between adjacent teeth, a pawl pivotally supported by said first and second end plates and formed with a first projection that has a substantially right angle surface receivable in said substantially right angle surfaces between adjacent teeth of said ratchet wheel, a second projection formed on said pawl and formed with a flat surface which is engageable with a mating flat surface on said handle so as to limit rotary motion of said pawl in a first direction, a third projection formed on said pawl on a side opposite said first projection formed with sharp corner, a U-shaped spring with a first and second legs joined in the middle and with bent portions formed at their free ends, said bent portion of said first leg engageable over said sharp corner of said third projection, and an opening formed in said handle in which said bent portion of said second leg is received.

2. An improved ratchet wrench according to claim 1 wherein said opening formed in said handle has a flat portion which is engageable with said second leg of said U-shaped spring.

3. An improved ratchet wrench according to claim 1 wherein said third projection of said pawl is formed with a flat portion engageable with said first leg of said U-shaped spring.

* * * * *